United States Patent [19]

Cellini

[11] Patent Number: 4,584,911

[45] Date of Patent: Apr. 29, 1986

[54] CORKSCREW DEVICE

[75] Inventor: Ferdinando Cellini, Maniago, Italy

[73] Assignee: Farm DI F.S.a.s., Maniago, Italy

[21] Appl. No.: 652,907

[22] Filed: Sep. 21, 1984

[30] Foreign Application Priority Data

Oct. 28, 1983 [IT] Italy ..... 60470/83[U]

[51] Int. Cl.[4] ..... B67B 7/04; B67B 7/44; B67B 7/16

[52] U.S. Cl. ..... 81/3.36; 81/3.09; 81/3.55

[58] Field of Search ..... 81/3.38 A, 3.34, 3.36, 81/3.46 R, 3.44, 3.1 R; D8/40, 42

[56] References Cited

U.S. PATENT DOCUMENTS 4,437,359 3/1984 Dejoux et al. ..... 81/3.38 A

FOREIGN PATENT DOCUMENTS 571272 2/1933 Fed. Rep. of Germany .
6570 of 1909 United Kingdom .

*Primary Examiner*—Roscoe V. Parker
*Attorney, Agent, or Firm*—Wegner & Bretschneider

[57] ABSTRACT

A corkscrew having a lever of the second order that is rotatably connected to each of a support to engage a bottle and a screw. The corkscrew is so configured that one can vary the distance between a pivot of the screw and a rotatable connection pin between the lever and the support.

12 Claims, 6 Drawing Figures

CORKSCREW DEVICE

This invention concerns a corkscrew device. To be more exact, the invention concerns a corkscrew device of a type having a screw means able to engage cork stoppers, and a lever means of the second order that acts on the screw means so as to draw the cork stoppers, the lever means comprising an articulated support portion intended to cooperate with the top of a bottle.

Corkscrews of the above type are known in a great variety of forms but all of them have a stationary fulcrum. This entails various drawbacks.

First of all, the known types have their fulcrum rather far from the pivot of the screw and therefore involve a high resistance moment and thus a considerable effort on the part of a user.

The reciprocal distance between the fulcrum of the lever and the pivot of the screw cannot be reduced by more than a given extent in such known solutions if contact is to be avoided during extraction between the cork and the support portion, such contact being due to the screw being too near the movable portion.

Next, as withdrawal of the cork proceeds, the screw is not extracted along the axis of the bottle but is displaced towards one side and the cork too is therefore not drawn along the axis of the bottle.

In this way there is an increase of friction owing to the fact that the cork is pressed sideways against the neck of the bottle and, moreover, the cork is usually damaged or broken during the operation, with the known unpleasant results (pieces of cork dropping into the wine, parts of the cork remaining inside the bottle, etc.).

The known art contains some embodiments intended to improve the functional nature of corkscrew devices.

Patent DE-C-571.272, for instance, discloses a corkscrew in which a rack is provided in the support position cooperating with the bottle so as to reduce angular rotation of the handle.

A toothed sector on the end of the handle, which in its turn is suitably guided in relation to such support position, meshes with such rack.

The ascent of the screw is multiplied in this way, the whole handle/screw group being lifted by the effect of such cooperation between the rack and the toothed sector.

EP-A-0041026 discloses a corkscrew in which the articulated portion comprises two separate support points for cooperation with the neck of the bottle. Withdrawal of the cork therefore takes place in two stages.

So as to facilitate positioning, it is made possible to displace the handle, in relation to the articulated portion, between two positions corresponding to such two support points.

GB-A-6570 works according to a principle different from that of the corkscrew of the present invention. It discloses a corkscrew of a type with a stationary sleeve cooperating with the neck of the bottle, whereas the screw is lifted by means of a lever of the first order pivoted on such stationary part.

The screw slides in the sleeve and is raised by the ascending movement of the end of the lever.

The working arm of the lever is thrust downwards to withdraw the cork in a manner analogous to that which takes place with common corkscrews with two arms.

The present invention has the purpose of obviating the drawbacks and shortcomings described at the beginning and of providing a device which has a better method of working than existing corkscrew devices.

One advantage of the invention is the smaller effort to be exerted by the user to draw the cork than with known embodiments.

Another advantage of the invention is that the cork is drawn substantially along the axis of the bottle. In this way the friction of the cork against the neck of the bottle and therefore the effort of extraction are reduced.

Moreover, possible breakage of the cork and/or deformation of the screw due to non-axial stresses and the foregoing relative drawbacks are avoided in this way.

The invention also provides the advantage of obviating contact between the cork and the support portion.

According to the invention means are envisaged which are able to condition the distance between the neighbourhood of the support portion and the pivot of the screw.

In this way the resistance arm, that is to say, the distance between the momentary fulcrum and the rotatable connection pivot of the screw, is conditioned.

In a preferred embodiment the fulcrum consists at least momentarily of a point of a cam means sliding against an appropriate surface or abutment of the support portion.

During manual rotation of the lever body of the device of the invention the cam means, as we said above, acts against the abutment means, or like means, of the support portion.

A displacement of the fulcrum on the lever body of the device is caused in this way in that the cooperation of that body with the support portion alters.

Thus a progressive reciprocal separation of the fulcrum and of the anchorage pivot of the screw corresponds with the angular rotation of the lever, such anchorage pivot being the point of application of the force of resistance.

A conditioning of the distance between the screw and the support portion is thus obtained and is such as to produce a substantially axial withdrawal of the cork and to prevent contact between the cork and the support portion while withdrawal is proceeding.

During withdrawal of the cork the lever body undergoes a composite displacement, which comprises a component of ascent due to the reciprocal action of the cam and support portion and also a component of lateral displacement corresponding to the separation of the pivot of the screw from the momentary fulcrum.

According to the above arrangement of the invention the resistance arm can be minimal at the beginning of the withdrawal operation, and this facilitates the beginning of the withdrawal when the force of resistance due to friction of the cork against the walls of the neck of the bottle is greatest.

As we said earlier, according to the invention the trajectory followed by the screw and therefore by the cork is substantially axial to the bottle.

The cork is damaged less in this way during the withdrawal operation than it would be damaged by the known corkscrew devices.

Furthermore, the person operating the device exerts less effort since, as the force applied is made substantially axial, the friction of the cork against the bottle during withdrawal is much less than is the case with known embodiments.

According to a variant the device of the invention comprises several given positions of cooperation of the support portion with the lever body.

The pre-selected position corresponds to the position of the fulcrum from time to time. Adjustments of such positions take place, for instance, by hand.

For example, it is possible to envisage slide paths machined in the lever body which have any required configuration and are provided with notches or equivalent means to position, in steps, a cooperation pin comprised on the support portion.

According to this variant the fulcrum coincides with the position of such pin.

In a further variant a variable position of the anchorage pivot of the screw on the lever body is envisaged. In this way it is possible to obtain the required reciprocal positions of the screw and of the fulcrum and thus the required resistance arm and also absence of contact between the cork and the support portion, the fulcrum being displaced by hand during withdrawal, such displacement being obtainable in several steps.

For instance, it is possible to effect such positioning with the pivot of the screw capable of being moved within notches in a path provided on the lever body of the device and comprising several notches.

According to a variant of the invention, means can be provided, such as an appropriate guide pin, for the automatic positioning of the lever body in relation to the support portion at the beginning of the operation.

The device of the invention can comprise auxiliary means such as hooks for crown corks, blades or punches which cooperate, for instance, with the handle, or other accessory means.

This invention is therefore embodied with a corkscrew device of a type including a lever body, or lever, of the second order rotatably connected to a support portion, and to a screw means, the device being characterized by comprising conditioning means able to condition at least the distance between a pivot of the screw and a rotatable connection pin between such lever body and such support portion.

We shall describe hereinafter, as non-restrictive examples, some embodiments of the invention with the help of the attached figures, in which.

Figure 4:
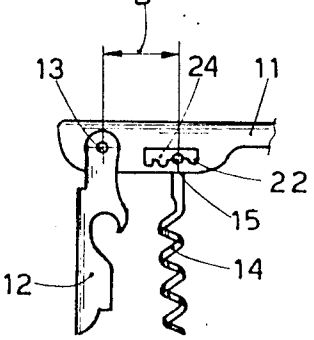
Figure 3A:
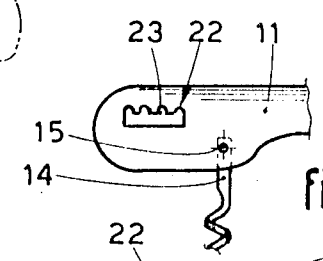
Figure 3B:
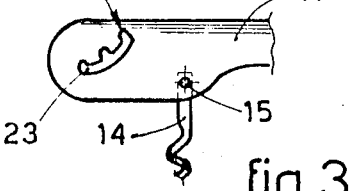
Figure 5:
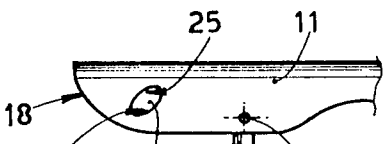

FIGS. *3a* and *3b* show possible variants;

FIG. 4 shows a further variant in which the position of the screw can be adjusted in relation to the lever body;

FIG. 5 shows yet another variant.

FIG. 6 shows a still further embodiment.

Figure 1:
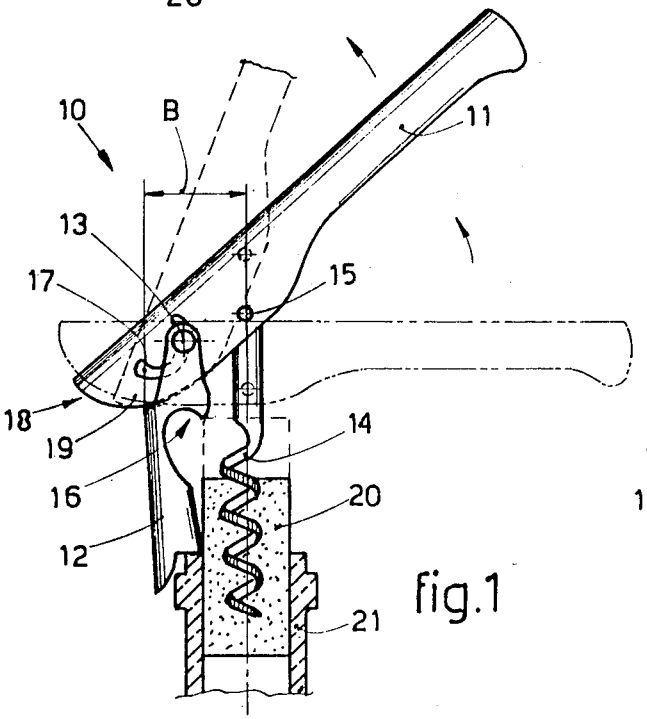
FIG. 1 is an embodiment of the invention providing variations of the fulcrum during operation.

In FIG. 1 a corkscrew device 10 includes a lever body 11 and a support portion 12 able to cooperate with a neck 21 of a bottle.

The corkscrew 10 also includes a screw 14 which is of a type known in itself and which is rotatably anchored at 15 to the lever body 11.

In this embodiment the support portion 12 is connected to the lever 11 in such a way as to be able to rotate and to slide.

In the example shown this connection is obtained by means of a coupling between a pin 13 and a slide path 17. This path 17 has the purpose of permitting the displacement of the pin 13 and therefore the displacement of the support portion 12 in relation to the lever 11 when the lever 11 is rotated so as to draw a cork 20, as will be made clear below.

In this example the pin 13 is located on the support portion 12 whereas the path 17 is comprised in the lever 11, but the converse of this arrangement can also be visualized without altering the functional nature of the assemblage.

Cooperation between the support portion 12 and the lever body 11 takes place, therefore, in a movable manner by means of the above continuous displacement path 17.

A cam means, or cam, 18 on the lever 11 presses against an abutment 19 of the support portion 12. During rotation of the lever body 11, an anticlockwise rotation in this example, the cam 18 causes a displacement of the lever body 11 in relation to the support portion 12.

In this embodiment the lever body itself 11 rises and, in the example of FIG. 1, is moved towards the right by the action of the cam 18 during rotation of the lever 11.

The momentary fulcrum of the lever 11 becomes constituted by the point of contact between the cam 18 and the abutment 19. This point of contact which constitutes the fulcrum moves along the cam 18 during rotation of the lever 11 and thus alters the resistance arm B according to the required law.

If the cam 18 is suitably conformed, the resistance arm B can be kept constant.

As can be seen in the figure, the movement of the cork 20 firmly attached to the screw 14 is substantially along the axis of the bottle during the whole course of rotation of the lever 11.

In this way any contact between the cork 20 and the support portion 12 is avoided since the support portion 12 and the pivot 15 of the screw 14 become further distanced from each other.

According to the configuration provided for the cam 18 the resistance arm B, as said earlier, may be constant or be variable but in the latter case will be preferably minimal at the beginning of withdrawal.

Figure 2:
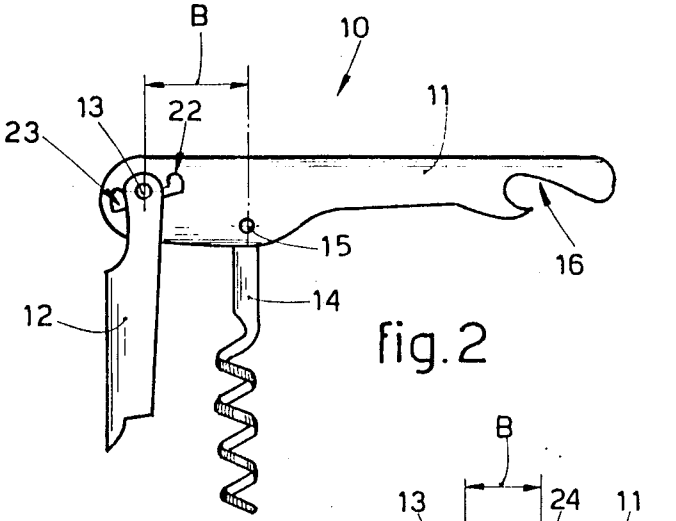
FIG. 2 shows a possible variant with adjustment of the position of the fulcrum by hand.

FIG. 2 shows a second embodiment of the invention in which the fulcrum of the lever 11 can be adjusted, it being possible to select several positions for the fulcrum.

In this case the fulcrum is determined by cooperation between the pin 13 of the support portion 12 and a path or slot 23 in the lever 11.

The path 23 includes notches 22 able to cooperate with the pin 13. By moving the pin 13 from one notch 22 to another it is possible to cause correspondingly a displacement of the fulcrum, and thus it is possible to regulate the resistance arm B. Such regulation is carried out independently of the rotation of the lever 11.

In this way a user can regulate the resistance arm B, even with movements in steps during withdrawal, in a way most suited to the resistance provided by the cork 20 and/or to the dimensions of the cork 20 itself and of the neck 21 of the bottle.

A user can also keep the cork 20 substantially axial to the bottle during withdrawal in this way.

The path or slot 23 with notches 22 can be made with any required configuration; it can be horizontal or sloped, straight or curved, and can include any required number of notches 22 or equivalent cooperation points (see FIGS. *3a* and *3b*).

It is also possible to envisage the path 23 as being in the support portion 12 and the pin 13 as being on the lever 11.

FIG. 4 shows a further variant in which the fulcrum of the lever 11 is stationary. In the example shown the fulcrum coincides with the pin 13.

In this variant the distance between the support portion 12 and the pivot 15 of the screw 14, and therefore the resistance arm B, is changed by moving the pivot 15 of the screw 14 from one notch 22 to another in an adjustment path 24 machined in the lever 11.

According to another variant, which is shown in FIG. 6, the cooperation between the screw 14 and lever 11 can be made continuously variable according to methods such as those shown in FIG. 1.

For instance, a cam means analogous to the cam means 18 can be provided which is able to act against a suitable abutment on the screw 14 so as to alter continuously the point of application of the resistance formed by the force of friction of the cork 20 against the neck 21 of the bottle.

A further variant of the invention, which is shown in FIG. 5, envisages a positioning path 25 cooperating with the pin 13 of the support portion 12. Such path 25 serves for the automatic positioning of the lever body 11 in relation to the support portion 12 at the beginning of the operation.

In fact, the path 25 has the effect that at the beginning of withdrawal of the cork 20 the lever body 11 and support portion 12 are positioned in such a way as to have the pin 13 automatically at the beginning of the continuous displacement path 17.

In this example the paths 17 and 25 together form the perimeter of a substantially elliptic slot 26.

In FIG. 5 the support portion 12 has been removed to provide a clear illustration, but it is to be understood that such portion 12 is of a type shown as an example in FIG. 1.

We have described here some preferred embodiments of the invention, but many variants are possible. For instance, it is possible to structure the cam means 18 and abutment 19 differently, for example by conforming the same 18–19 respectively as a slot and as a pin.

It is possible to apply auxiliary means such as resilient means, for instance, between the lever 11 and support portion 12 so as to facilitate the positioning of such portion 12.

Any required auxiliary means such as blades, punches, etc. can also be applied so as to cooperate in a retractable manner with the lever body 11.

I claim:

1. A corkscrew device comprising a lever means of the second order, a support to which said lever means is rotably connected, screw means to which said lever means is connected, said screw means having a pivot, a rotatable connection pin between said lever means and said support, the distance on said lever means between said pivot and said rotatable connection pin defining a resistance arm, and conditioning means comprising a cam means cooperating with an abutment means for varying said resistance arm.

2. The corkscrew device of claim 1 further comprising continuous guide path means cooperating with said rotatable connection pin.

3. The corkscrew device of claim 2 wherein said conditioning means are provided in correspondence with the cooperation of said lever means with said support.

4. The corkscrew device of claim 2 wherein said conditioning means is provided in correspondence with the cooperation of said lever with said screw means.

5. The corkscrew device of claim 2 further comprising at least one automatic positioning path cooperating momentarily with said rotatable connection pin.

6. The corkscrew device of claim 5 wherein said automatic positioning path together with a continuous guide path defines a substantially elliptical slot.

7. The corkscrew device of claim 1 wherein said conditioning means are provided in correspondence with the cooperation of said lever means with said support.

8. The corkscrew device of claim 1 wherein said conditioning means is provided in correspondence with the cooperation of said lever with said screw means.

9. The corkscrew device of claim 1 further comprising at least one automatic positioning path cooperating momentarily with said rotatable connection pin.

10. The corkscrew device of claim 9 wherein said automatic positioning path together with a continuous guide path defines a substantially elliptical slot.

11. The corkscrew device of claim 1 wherein the resistance arm of said lever means is kept substantially constant at least during part of the course of a withdrawal of a cork.

12. The corkscrew device of claim 1 wherein the resistance arm of said lever means can be varied continuously.

* * * * *

UNITED STATES PATENT AND TRADEMARK OFFICE

CERTIFICATE OF CORRECTION

PATENT NO. : 4,584,911

DATED : April 29, 1986

INVENTOR(S) : Ferdinando Cellini

It is certified that error appears in the above-identified patent and that said Letters Patent are hereby corrected as shown below:

In the Assignment information, item [73] on the first page of the Patent, delete "Farm DI F.S.a.S." and insert --FARM DI F. CELLINI S.a.S.--

Signed and Sealed this

Twenty-third Day of December, 1986

*Attest:*

DONALD J. QUIGG

*Attesting Officer* *Commissioner of Patents and Trademarks*